US009011276B2

(12) United States Patent
Holland

(10) Patent No.: US 9,011,276 B2
(45) Date of Patent: Apr. 21, 2015

(54) FOOTBALL KICKING TEE

(71) Applicant: Pro Performance Sports, L.L.C., Carlsbad, CA (US)

(72) Inventor: Allen Holland, Sheffield (GB)

(73) Assignee: Pro Performance Sports, L.L.C., Carlsbad, CA (US)

( * ) Notice: Subject to any disclaimer, the term of this patent is extended or adjusted under 35 U.S.C. 154(b) by 137 days.

(21) Appl. No.: 13/898,792

(22) Filed: May 21, 2013

(65) Prior Publication Data

US 2014/0349784 A1 Nov. 27, 2014

(51) Int. Cl.
*A63B 71/00* (2006.01)
*A63B 69/00* (2006.01)

(52) U.S. Cl.
CPC ..... *A63B 69/0075* (2013.01); *A63B 2243/007* (2013.01)

(58) Field of Classification Search
USPC ..... 473/417, 419, 420, 438, 387, 396; D21/716, 717, 788
See application file for complete search history.

(56) References Cited

U.S. PATENT DOCUMENTS

| | | | | | |
|---|---|---|---|---|---|
| 3,087,726 | A | * | 4/1963 | Pogue | 473/420 |
| 3,309,087 | A | | 3/1967 | Cullity | |
| 3,414,268 | A | * | 12/1968 | Chase | 473/396 |
| D261,789 | S | | 11/1981 | Allen | |
| 4,418,910 | A | | 12/1983 | Stenerud | |
| D275,303 | S | | 8/1984 | Box, Sr. | |
| D277,973 | S | * | 3/1985 | Stenerud | D21/716 |
| 4,537,397 | A | * | 8/1985 | Kopp | 473/420 |
| 4,655,453 | A | * | 4/1987 | Spiegel et al. | 473/420 |
| 4,657,252 | A | | 4/1987 | Spiegel | |
| D291,714 | S | | 9/1987 | Spiegel | |
| D305,448 | S | * | 1/1990 | Spiegel | D21/716 |
| D309,168 | S | | 7/1990 | Smith | |
| 4,946,165 | A | | 8/1990 | Rambacher | |
| 5,100,135 | A | * | 3/1992 | Bourgeois | 473/420 |
| 5,501,454 | A | | 3/1996 | Frantz | |
| 5,505,445 | A | | 4/1996 | Treadwell et al. | |
| D372,062 | S | | 7/1996 | Spiegel | |
| D383,816 | S | | 9/1997 | Spiegel | |
| D383,817 | S | | 9/1997 | Spiegel | |
| D392,705 | S | | 3/1998 | Spiegel | |
| 6,170,787 | B1 | | 1/2001 | Morgan | |
| 6,309,316 | B1 | | 10/2001 | Spiegel | |
| D579,994 | S | | 11/2008 | Lowinger | |
| 7,452,293 | B2 | | 11/2008 | Spiegel | |
| D634,798 | S | | 3/2011 | Suisham et al. | |
| D664,221 | S | | 7/2012 | Spiegel | |
| 8,262,514 | B2 | * | 9/2012 | Spiegel et al. | 473/420 |
| 8,517,864 | B2 | | 8/2013 | Spiegel | |
| D703,281 | S | * | 4/2014 | Holland | D21/716 |
| 2012/0329582 | A1 | * | 12/2012 | Spiegel | 473/420 |

* cited by examiner

*Primary Examiner* — Mark Graham
(74) *Attorney, Agent, or Firm* — Kenneth H. Ohriner; Perkins Coie LLP

(57) ABSTRACT

A tee for holding an American style football during place kicking has a base with a receptacle. A block is removably inserted into the base, with the block having a front cup and a rear cup. A plurality of radial tabs in the front cup can independently bend and deflect to securely hold footballs having a range of different sizes and shapes. The tabs may be provided on fingers, with each finger having an upright arm joined to a ring base, and with a tab attached to and extending radially inwardly from each upright arm.

19 Claims, 6 Drawing Sheets un-flexed flexed (small ball)

un-flexed with ball size dashed overlay flexed (college ball)

flexed (large NFL ball)

FOOTBALL KICKING TEE

FIELD OF THE INVENTION

The field of the invention is tees for holding an American style football.

BACKGROUND OF THE INVENTION

Various tees have been used to hold a football for place kicking, during practice or during actual play of a game. The tee must be able to securely hold the ball in a desired orientation, typically with the longitudinal axis of the ball inclined slightly towards the rear. The tee must also avoid interfering with the trajectory of the ball after the ball is kicked. The tee should also avoid interfering with movement of the kicker's foot. For league play, the tee may also have to comply with applicable equipment rules.

SUMMARY OF THE INVENTION

A tee for holding an American style football may have a base with a receptacle. A block may be removably inserted into the base, with the block having a front cup or recess and a rear cup or recess. A plurality of radial tabs in the front cup can independently bend and deflect to securely hold footballs having a range of different sizes and shapes. The tabs may be provided on fingers, with each finger having an upright arm joined to a ring base, and with a tab attached to and extending radially inwardly from each upright arm. The block may be separately used as a tee without the base.

BRIEF DESCRIPTION OF THE DRAWINGS

In the drawings, the same element number indicates the same element in each of the views.

DETAILED DESCRIPTION OF THE DRAWINGS

Figure 1:
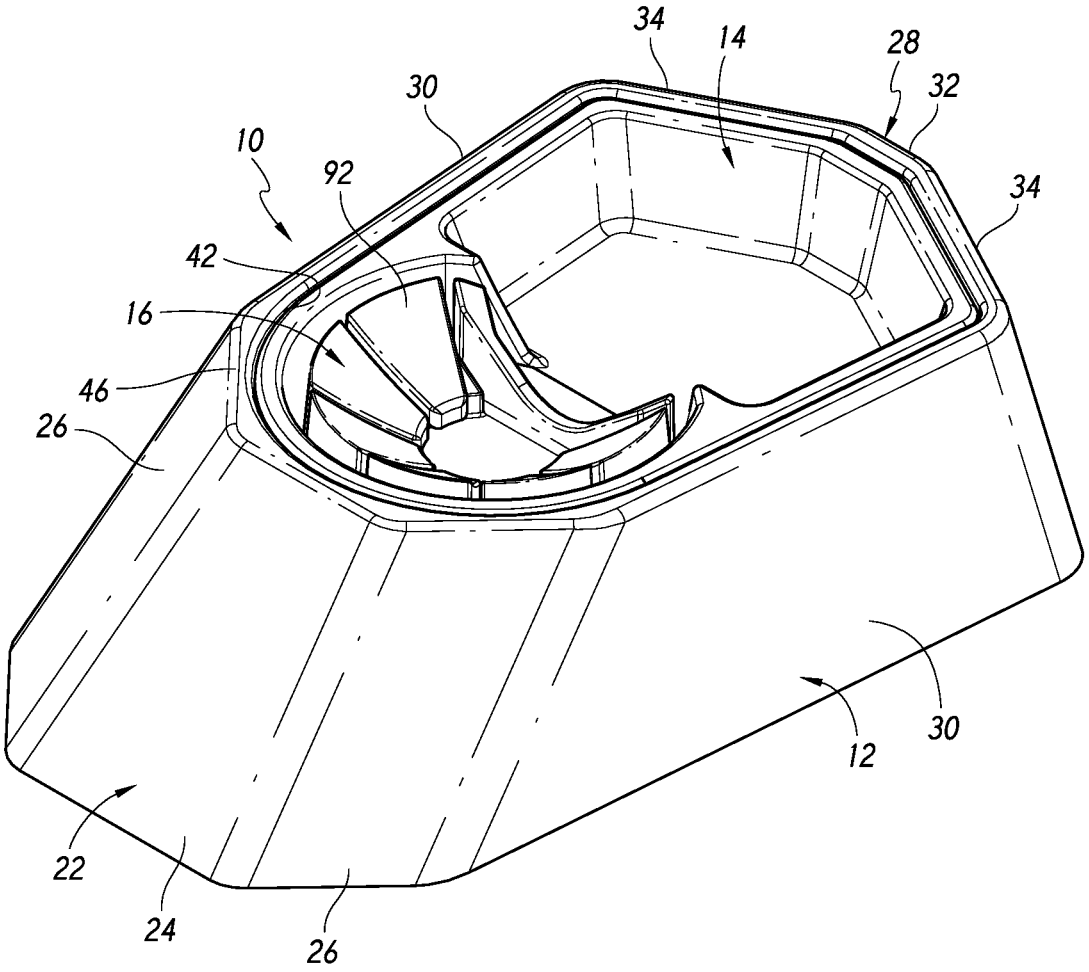
FIG. 1 is a rear, top and right side perspective view of a new tee.
Figure 2:
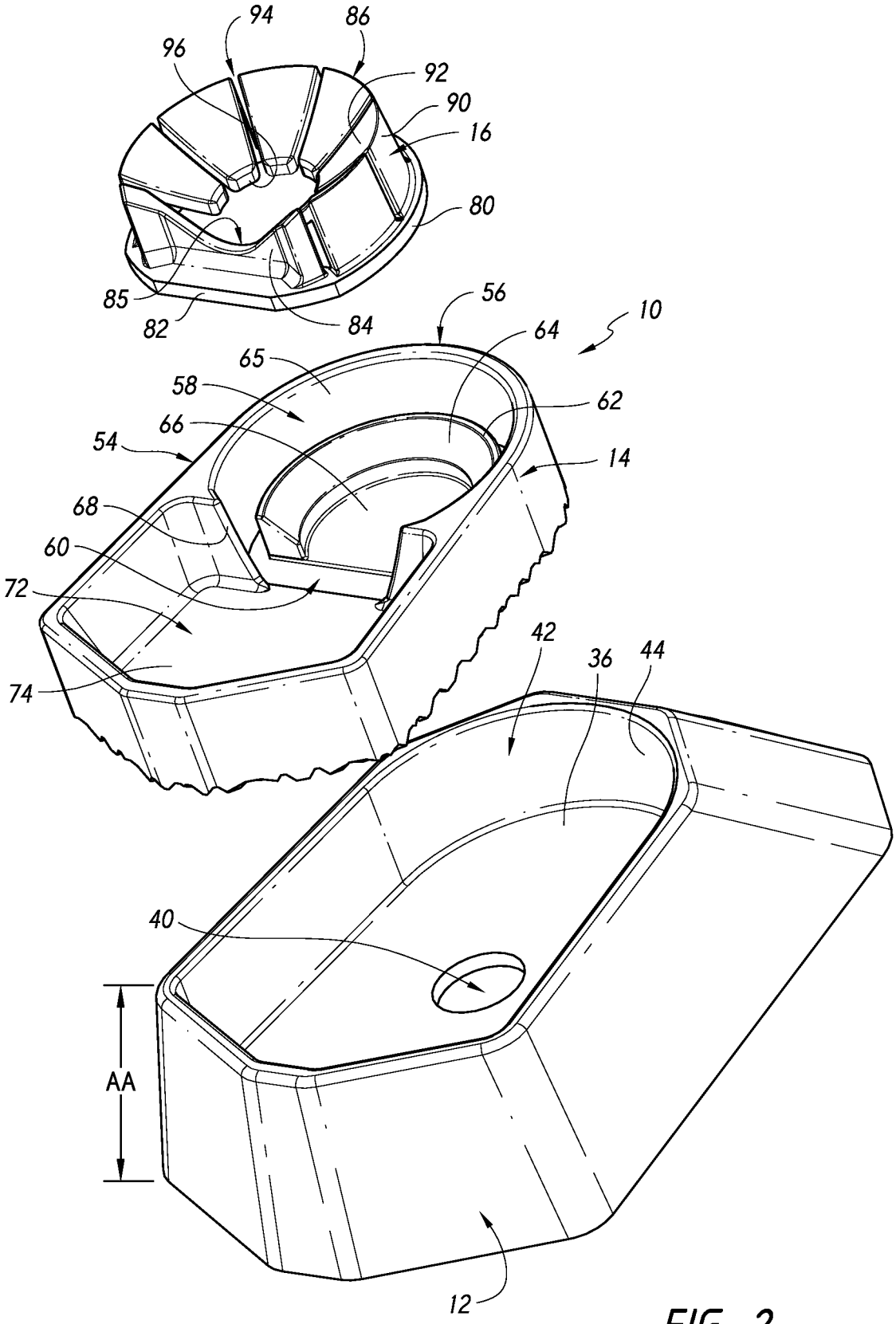
FIG. 2 is an exploded front, top and left side perspective view of the tee shown in FIG. 1.
Figure 3:
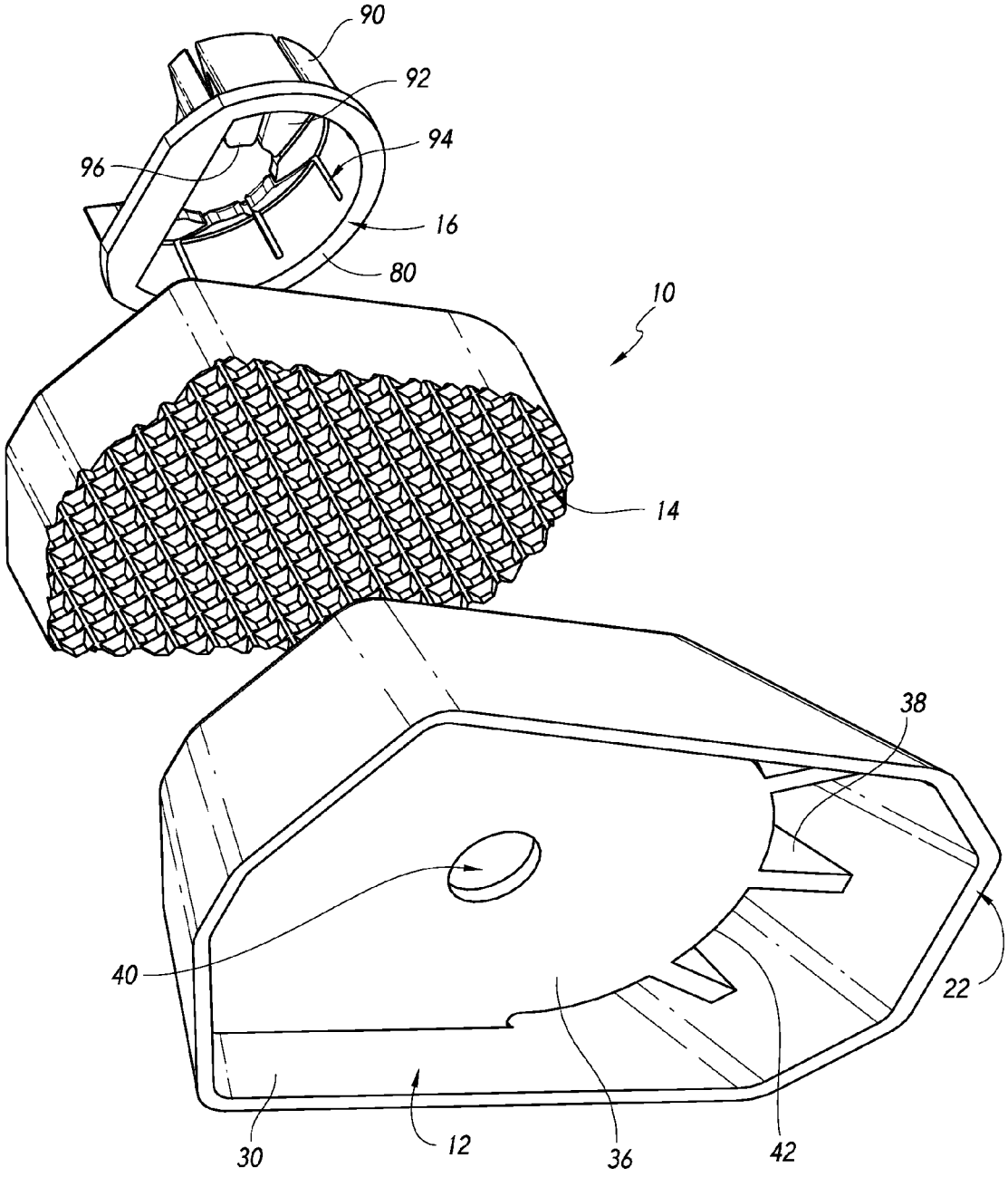
FIG. 3 is an exploded front, bottom and left side perspective view of the tee shown in FIG. 1.

As shown in FIGS. 1-4, a football tee 10 may be provided with a base 12, and a block 14 having a finger ring 16. As shown in FIG. 1, the base 12 in the example shown has an angled front section 22 formed by a front center surface 24 adjoining left and right front side surfaces 26. In use the front section 22 is the section facing the kicker. Side walls 30 of the base 12 may extend from the front section 22 to a rear section 28 having a rear center surface 32 adjoining left and right rear side surfaces 34. As shown in FIG. 3, the inner wall 44 of the front section may be semicircular. Turning momentarily to FIG. 3, the base 12 may have a floor 36 connecting to the side walls 30 and to the front and rear sections 22 and 28. One or more gussets 38 may attach to the floor and to the outside surface of the inner wall 44 of the front section 22. A through hole 40 may optionally be provided at a central position of the floor 36. Referring back to FIG. 2, a receptacle space 42 is formed in the base 12 above the floor 36 and between the side walls 30, and the front and rear sections 22 and 28.

Figure 4:
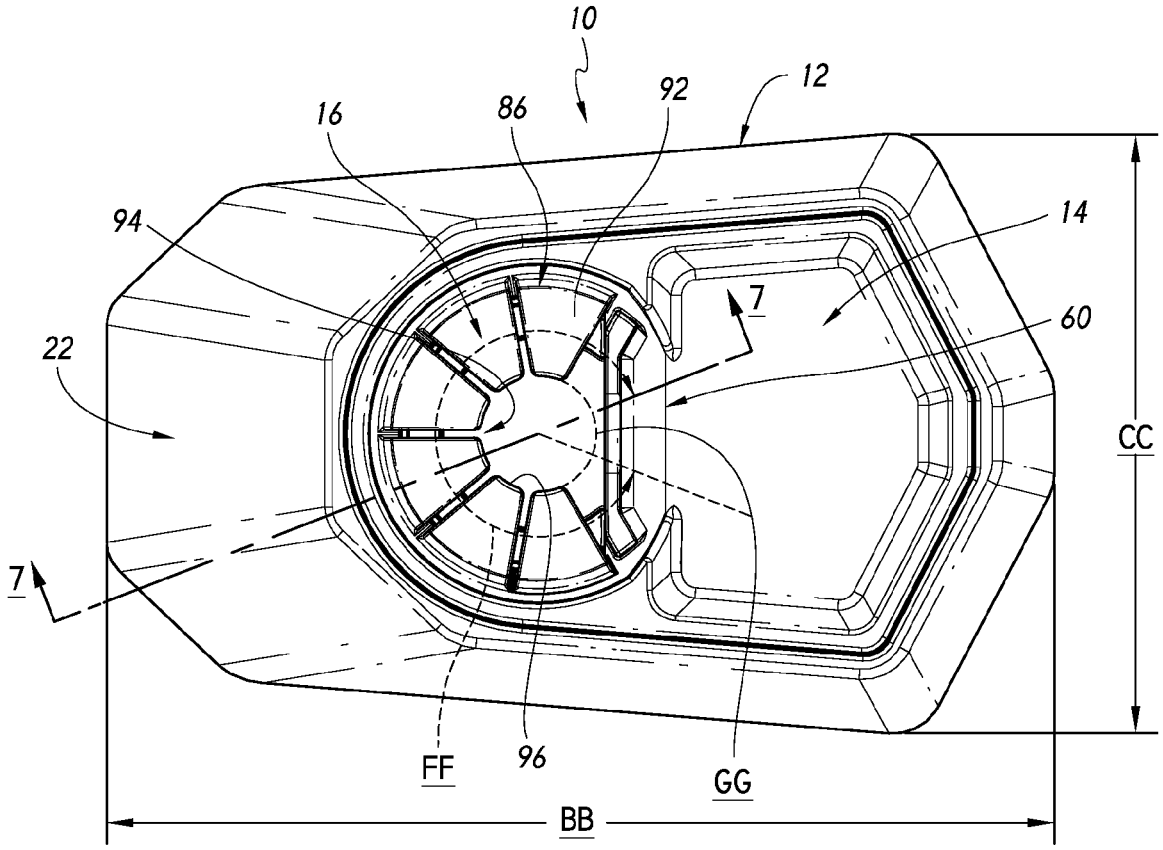
FIG. 4 is a plan view of the tee shown in FIG. 1.
Figure 5:
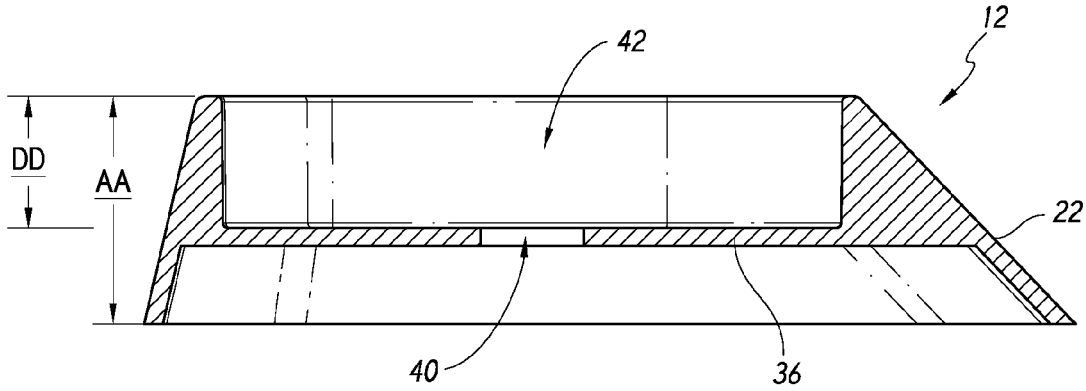
FIG. 5 is a center line section view of the tee base as shown in FIGS. 2 and 3.

As shown in FIGS. 1 and 5, the base 12 may have a height AA of 34-54 or 40-48 mm, with the height DD of the side walls 30 above the floor 36 ranging from 20-30 mm, and the floor having a thickness of typically about 3-5 mm. As shown in FIG. 4 the base 12 may have an overall length BB of about 160-200 or 170-190 mm and an overall width CC of about 100-130 mm.

Turning to FIGS. 1-3, the block 14 is shaped and dimensioned so that it may pressed into and removed from the receptacle 42 by hand. The perimeter of the block 14 generally indicated by 54 in FIG. 2 corresponding is nominally smaller than the perimeter of the receptacle 42. The bottom surface of the block 14 may be patterned with projections 52, teeth, or a similar textured or patterned gripping surface. As shown in FIG. 2, a front cup 58 and a rear cup 72 may be formed on the top side of the block 14. The front cup 58 may be formed by a circumferential wall 65 having a radius of e.g. 24-30 mm, and having a front opening 60. A C-ring 62 may be centered within the circumferential wall 65 and attached to a floor 66 of the front cup 58. The C-ring 62 may optionally have an angled surface 64.

The rear ends of the circumferential wall 65 may extend inwardly towards each other forming cup edges 68 between the front cup 58 and the rear cup 72. The spacing between the cup edges 68 forms the clearance opening 60 for the tip of the football to pass through when kicked. The clearance opening 60 correspondingly may be described as a chord cutting across the wall 65 so that the wall 65 subtends the arc FF in FIG. 4 ranging from about 200 to about 250 degrees. The arc FF is made large enough to fit a number of tabs 92 sufficient to securely hold the football, and small enough so that the clearance opening 60 is large enough to avoid having the bottom end of the football collide with tee after the ball is kicked.

Figure 6:
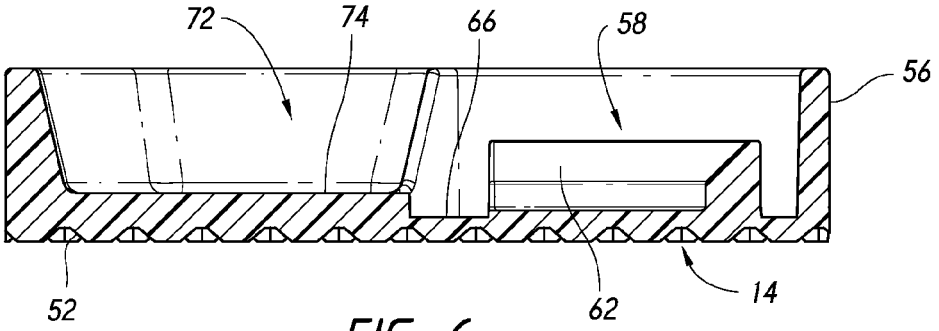
FIG. 6 is a center line section view of the tee block as shown in FIGS. 2 and 3.

Referring to FIG. 6, the floor 74 of the rear cup 72 may be raised above the floor 66 of the front cup 58, resulting in a step between the cups 58 and 72. As shown in FIG. 4, the rear cup 72 may have an irregular polygonal shape generally matching the shape of the rear section 28 of the base 12. In the example shown, the rear cup 72 has six sides, including a short rear segment aligned with and parallel to the rear center surface 32. In some designs the short rear segment may be omitted with the rear cup 72 generally having the shape of a regular pentagon.

Turning now to FIGS. 2-4 and 7, the finger ring 16 may have a plurality of circumferentially spaced apart radial fingers 86, with each finger 86 having an upright arm 90 joined to a ring base 80, and a tab 92 joined to each arm 90. As shown in FIG. 4, the tabs 92 may be tapered or triangular, with truncated inner ends 96 aligned on the diameter GG. Straight or angled slots 94 may be used to separate the fingers 86. In the example shown, the finger ring 16 has six identical fingers, and a straight front wall 84. In other designs, the finger ring may have other numbers of fingers, fingers of varying sizes and shapes, and/or fingers having tabs with the arms omitted. For example the tabs 92 may be joined to a surrounding sidewall without any arms and/or without any ring base.

Figure 7:
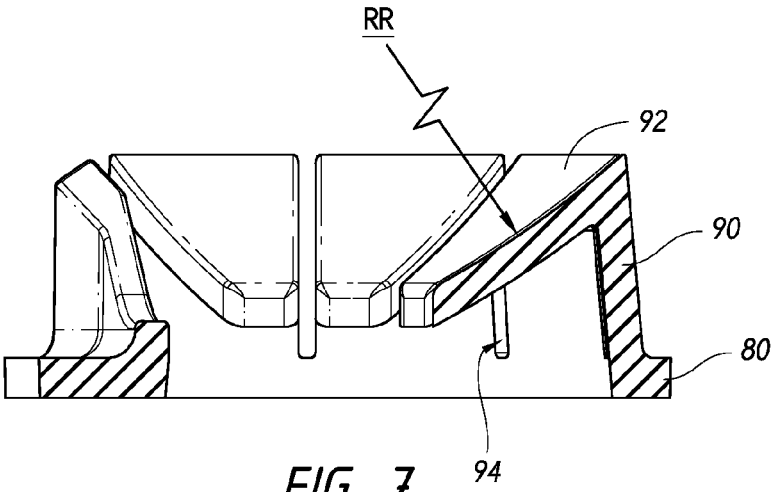
FIG. 7 is a section view of the finger ring shown in FIGS. 1-4 taken along line 7-7 of FIG. 4.

Referring to FIG. 7, the top surface of each tab 92 may be concave, with a radius RR of 80-120 mm, or otherwise curved to receive the curved surface of the tip of the football used with the tee. The tabs 92 may be inclined on a downward angle from the arm 90 towards the inner ends 96 at an angle of 20-40 degrees. The outside diameter of the ring base 80 and the straight front edge 82 may provide a D-shaped finger ring 16 adapted for attachment into the front cup 58 of the block 14. In this case, the bottom surface of the ring base 80 and/or the lower inside surfaces of the arms 90 may be adhered or otherwise substantially permanently attached to the block 14. In some designs the finger ring 16 may be omitted entirely with tabs 92 provided directly on the block 14. As will be apparent from the drawings and the description above, the base 12, the block 12 and the finger ring 16 may be symmetrical about a longitudinal centerline.

As shown in FIG. 1, with the finger ring 16 attached to the block 14, and with the block 14 placed into the base 12, the highest point on the fingers 86 (where the arm 90 joins the tab 92) is substantially flush, or below flush with the upper edge 46 of the base 12.

In use the block 14 is pressed into the receptacle to provide a tee 10 as shown in FIG. 1. The base 12, the block 14 and the finger ring 16, if used, may be made of a resilient material, such as rubber. This allows small amounts of bending, flexing and/or displacement as may be needed to press the block 14 into the base 12. The block 14 is held securely in the base 12 via friction and/or elastic compression forces.

A pointed end of a football is inserted into the diameter GG surrounded by the tabs 92. As this occurs, the tabs may flex downwardly. The angled surface 64 of the C-ring may provide a hard stop limiting the downward flexing of the tabs 92. The fingers 86 may also flex radially outwardly as the football is inserted between the tabs. The flexing of the tabs, and/or the flexing of the fingers, allows the tee 10 to better accommodate a greater range of balls of varying shapes and sizes. The recess 85 in the front wall 84, and the rear cup 72 provide clearance so that the ball does not collide with the tee after the ball is kicked. The front section 22 may incline at an angle of 35-55 or 40-50 degrees. If the kicker's foot approaches too low, the angle of the front section may help to guide the foot up towards the ball.

With the tee as shown in FIG. 1 placed on the ground, the floor 66 of the front cup 58 is about 30-40 mm above the ground. For lower placement, the block 14 may be removed from the base 12 by pushing it out using the finger hole 40. The block 14 may then be placed on the ground and used as a tee, without the base 12. This allows placement of the ball less than 10 mm above the ground.

Figure 8:
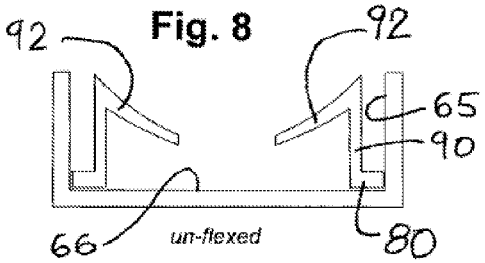
FIG. 8 is another section view of the finger ring with the fingers un-flexed.
Figure 9:
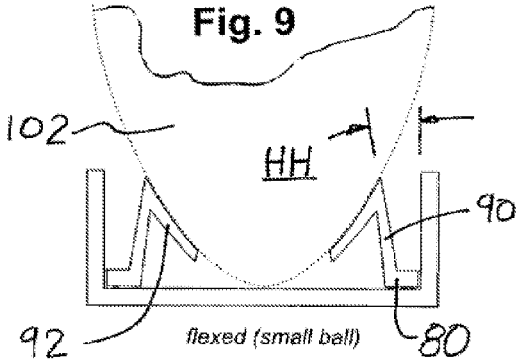
FIG. 9 is a schematic illustration showing the flexing of the fingers of the finger ring when holding a small football.

As shown in FIGS. 8-13, the tee is adaptable for holding different size footballs. FIG. 8 shows the flaps or tabs 92 in the nominal unflexed state, with no football in place. FIG. 9 shows the position of the tabs 92 when holding a small football 102. As the small football 102 is placed onto the tee, the tabs 92 flex down and in. The upright arm 90 flexes inwardly forming an angle HH to the vertical sidewall 65. The ring base 80 remains fixed on the floor 66. The angle HH is positive, i.e. inclined inwardly, and may typically range from 10 to 30 degrees.

Figure 10:
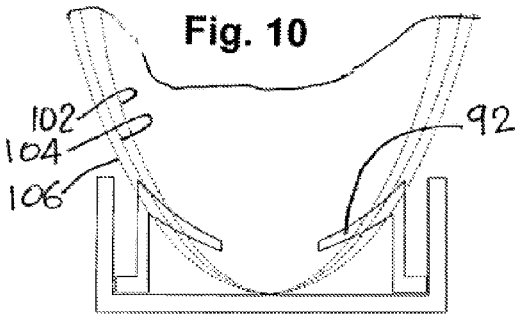
FIG. 10 is a schematic illustration showing fingers of the finger ring unflexed in relation to three different size footballs.
Figure 11:
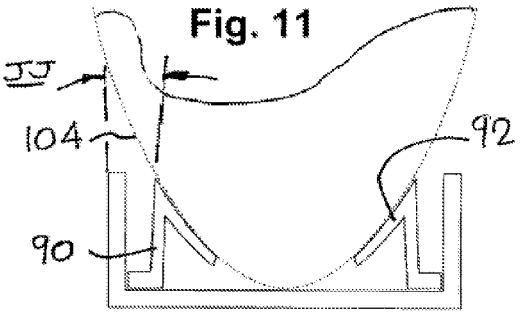
FIG. 11 is a schematic illustration similar to FIG. 9 but with a medium size football.

FIG. 10 shows the relative sizes of small, medium and large footballs 102, 104 and 106. The medium football 104 is representative of a college football. The large football 106 is representative of a professional NFL football. FIG. 11 illustrates the medium football 104 on the tee. Again the tabs 92 are flexed inwardly, at a positive angle JJ, with JJ less than angle HH, so that the upright arms 90 of the tabs are closer to vertical than in FIG. 9.

Figure 12:
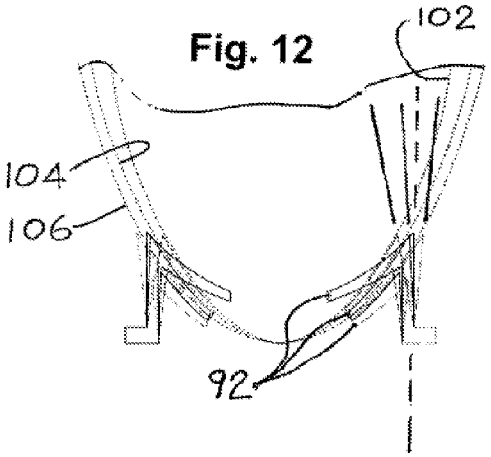
FIG. 12 is a schematic illustration similar to FIG. 10 but also showing the flexing of the fingers in relation to the three different size balls held in the tee.
Figure 13:
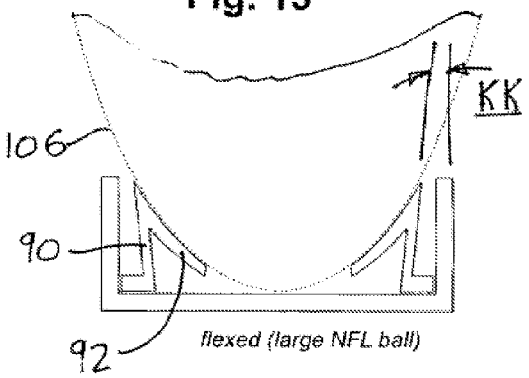
FIG. 13 is a schematic illustration similar to FIGS. 9 and 10 but with a large size football.

FIG. 12 shows the relative sizes of the footballs 102, 104 and 106, and also the positions of the tabs 92 when each size football is placed on the tee. As shown in FIGS. 12 and 13, when holding the large size football, the tabs may be flexed outwardly at a negative angle KK, typically ranging from 1 to 20 degrees, or from 5 to 10 degrees.

Thus, a novel kicking tee has been shown and described. Various changes and substitutions may of course be made without departing from the spirit and scope of the invention. The invention, therefore, should not be limited except by the following claims, and their equivalents.

The invention claimed is:

1. A tee comprising:

a block having a floor;

a plurality of tabs on a ring on the block, with the tabs above the floor and oriented at an acute angle to the floor, and the tabs extending radially inwardly on the block;

the tabs circumferentially spaced apart on an arc section of the ring;

the ring having an open section on one side of the arc section;

a recess in the block facing the open section of the ring; and a plurality of upright arms attached to the floor with a tab attached to each of the upright arms.

2. The tee of claim 1 with the tabs comprising a thin and flexible material deflectable by a football placed on the tee.

3. The tee of claim 1 with the tabs having a substantially triangular shape.

4. The tee of claim 3 with each tab having a truncated inner end arranged on an inner tab circle.

5. The tee of claim 1 having 4-7 equally spaced apart tabs.

6. The tee of claim 1 with the tabs having a concave top surface.

7. The tee of claim 1 with the tabs on a finger ring attached to the block.

8. The tee of claim 1 further including a C-ring on the floor of the block having an angled ring surface, and with the tabs downwardly deflectable until they contact the angled ring surface.

9. The tee of claim 1 with the arms outwardly flexible by a football placed on the tee.

10. The tee of claim 1 further comprising a base having a receptacle above a base floor, and with the block inserted into the receptacle.

11. The tee of claim 1 with the tabs forming substantially conical surface segments.

12. The tee of claim 1 with the arc section of the ring subtending an angle of 180 to 250 degrees.

13. A football tee, comprising:

a base having a receptacle;

a block removably inserted into the base, with the block having a front cup and a rear cup; and a plurality of radial tabs in the front cup, with the tabs flexibly attached to the block.

14. The tee of claim 13 with the tabs on a finger ring attached to the block.

15. The tee of claim 14 with each tab attached to an upright arm on the finger ring.

16. The tee of claim 14 with the finger ring comprising a circular ring having a flat front edge, and a wall having a recess at the flat front edge.

17. The tee of claim 15 with the finger ring including a ring base, the upright arms attached to the ring base, and a space between each of the tabs and each of the upright arms, to allow the tabs to independently deflect upon placing a ball on the tee.

18. A tee comprising:

a block having a floor;

a plurality of tabs on a ring on the block, with the tabs above the floor and oriented at an acute angle to the floor, and the tabs extending radially inwardly on the block;

the tabs circumferentially spaced apart on an arc section of the ring;

the ring having an open section on one side of the arc section;

a recess in the block facing the open section of the ring; and a C-ring on the floor of the block having an angled ring surface, and with the tabs downwardly deflectable until they contact the angled ring surface.

19. The tee of claim 18 further comprising a plurality of upright arms attached to the floor with a tab attached to each of the upright arms.

* * * * *